United States Patent [19]

Pelekis

[11] 4,312,629

[45] Jan. 26, 1982

[54] UNIVERSAL ROTATING MACHINE FOR EXPANDING OR COMPRESSING A COMPRESSIBLE FLUID

[75] Inventor: Emmanouil A. Pelekis, Athens, Greece

[73] Assignee: General Supply (Constructions) Co. Ltd., Athens, Greece

[21] Appl. No.: 180,349

[22] Filed: Aug. 22, 1980

[51] Int. Cl.[3] ..... F01C 1/20; F01C 11/00; F04C 18/20; F04C 23/00

[52] U.S. Cl. ..... 418/191; 418/196; 418/200

[58] Field of Search ..... 418/191, 196, 200

[56] References Cited

U.S. PATENT DOCUMENTS

| | | | |
|---|---|---|---|
| 652,317 | 6/1900 | Knowles | 418/200 |
| 899,148 | 9/1908 | Westrich | 418/191 |
| 931,785 | 8/1909 | Miller | 418/196 |
| 962,850 | 6/1910 | Leedham | 418/191 |
| 1,037,455 | 9/1912 | Diefenderfer | 418/196 |
| 1,112,844 | 10/1914 | Schnitter | 60/39.6 |
| 1,983,216 | 12/1934 | Carter et al. | 418/196 |
| 2,062,753 | 12/1936 | Linn | 123/238 |
| 2,690,869 | 10/1954 | Brown | 418/191 |
| 3,472,445 | 10/1969 | Brown | 418/200 |
| 3,782,340 | 1/1974 | Nam | 418/191 |
| 3,863,609 | 2/1975 | Ikarashi | 418/191 |

FOREIGN PATENT DOCUMENTS

| | | | |
|---|---|---|---|
| 2328388 | 1/1974 | Fed. Rep. of Germany | 418/196 |
| 2525955 | 12/1976 | Fed. Rep. of Germany | 123/238 |
| 1154802 | 11/1957 | France | 418/196 |
| 681038 | 10/1952 | United Kingdom | 123/238 |

*Primary Examiner*—John J. Vrablik

*Attorney, Agent, or Firm*—Finnegan, Henderson, Farabow, Garrett & Dunner

[57] ABSTRACT

A pair of tangential rotors are provided on separate shafts dependently rotatable in a housing, one having a vane and the other a notch for allowing passage of the vane, to form a fluid-tight segmented annular region through which the vane moves. A valve admits a mass of high pressure compressible fluid to the region through a triangular port for expansion, or from the region after compression, the mass of fluid being confined in a portion of the region between the vane and the surface of the notched rotor and changing in pressure because of the change in arcuate length and thus volume of the confined region portion. Multiple pairs of rotors may be included on the one rotor and two notches on the other. Two vaned rotors may cooperate with one notched rotor, the vaned rotors being on separate shafts.

18 Claims, 11 Drawing Figures

UNIVERSAL ROTATING MACHINE FOR EXPANDING OR COMPRESSING A COMPRESSIBLE FLUID

BACKGROUND OF THE INVENTION

1. Field of the Invention

This invention relates to machines of the rotary type useful for expanding or compressing a compressible fluid such as air from one pressure to a different pressure.

2. Description of the Prior Art

The relevant prior art devices useful for either expanding or compressing a compressible fluid include at least the centrifugal and axial rotary-type compressors with fixed or sliding vanes.

SUMMARY OF THE INVENTION

In accordance with the present invention, as embodied and broadly described herein, the apparatus of this invention for changing the pressure of a mass of fluid comprises a group of tangential rotors of circular cross section rotatable in a housing; a fluid-tight region formed in its housing adjoining the peripheral surface of one of the rotors, the region being a segment of an annulus terminating at each end at the peripheral surface of another of the rotors; at least one vane on the peripheral surface of the one rotor, the extremities of the vane sealingly engaging the opposing surfaces of the housing that bound the annulus; vane relief means in the peripheral surface of the another rotor and shaped for receiving the vane during rotation of the vane past the another rotor, the vane and the vane relief means being in sealing relationship during at least a portion of the period when the vane is received in the vane relief means; at least two paths in said housing for fluid flow into and out of said region at different pressures; and valve means for intermittently interrupting the flow of fluid in said path carrying the higher pressure fluid.

Preferably, the group of rotors includes first and second rotors which are fixedly attached to respective separate shafts mounted for rotation in the housing, and the apparatus further includes means for coupling the respective shafts for providing rotation of the first and the second rotors in opposite angular directions, the coupling means also providing registration between the vane and the vane relief means during rotation of the first and the second rotors.

It is also preferred that the vane has a face directed toward the fluid mass and the vane relief means includes a notch forming an axially directed edge with the peripheral surface of the second rotor, and wherein the profile of the vane face corresponds to the path traced in the vane member by the edge during the concurrent rotation of the first and second rotors, said edge slidingly engaging the vane face during rotation of the vane past the second rotor for providing fluid-tight seal between the face and the edge.

It is still further preferred that the apparatus housing includes a pair of opposing end walls facing the respective axial faces of the first rotor and forming part of the boundary of the segmented annulus, wherein the path carrying fluid at high pressure includes a high pressure port located in the end wall proximate the projections of the convergence of the peripheral surfaces of the first and second rotors on the end wall, and wherein the high pressure port has a generally triangular shape with a vertex pointing toward the convergence.

The accompanying drawing, which is incorporated in, and constitutes a part of, the specification, illustrates several embodiments of the invention and, together with the description, serves to explain the principles of the invention.

DESCRIPTION OF THE PREFERRED EMBODIMENTS

Reference will now be made in detail to the present preferred embodiments of the invention, examples of which are illustrated in the accompanying drawing.

Figure 1:
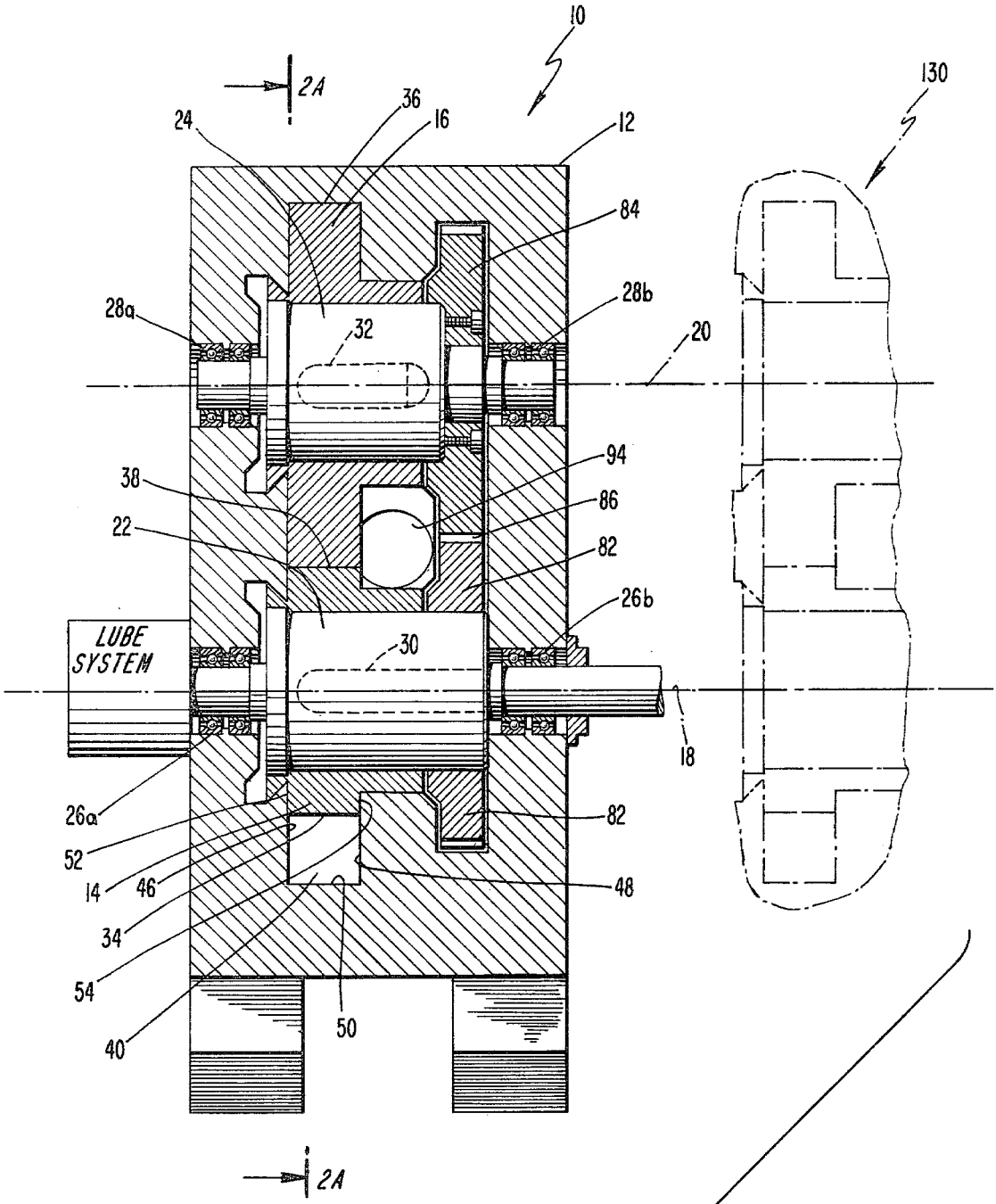
FIG. 1 is a cross-Sectional schematic of one embodiment of the apparatus made in accordance with this invention for changing the pressure of a mass of fluid.
Figure 2B:
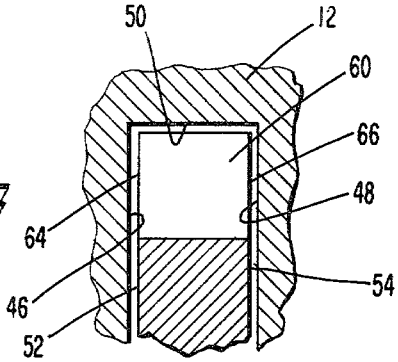
FIG. 2B is a detail of a part shown in FIG. 2A.
Figure 2A:
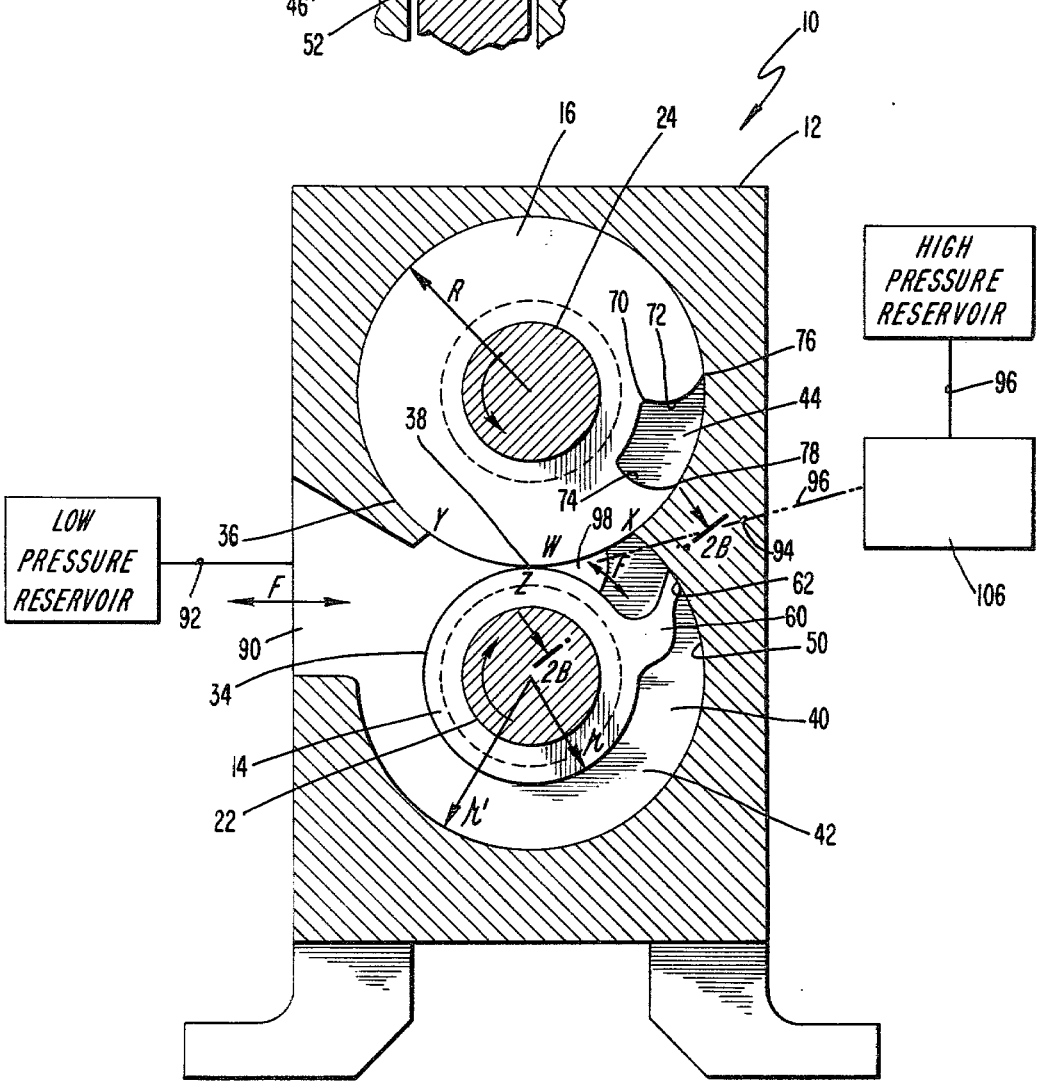
FIG. 2A is a cross-sectional view of the embodiment shown in FIG. 1.

Referring now to the embodiment shown in FIGS. 1 and 2A, there is shown apparatus 10 for changing the pressure of a mass of a compressible fluid from one pressure level to another. When the second pressure level is greater than the first pressure level, the apparatus 10 acts as a compressor and power must be applied to the device to effect the compression, a portion of the power emerging as an increase in the internal energy of the compressible fluid. When the second pressure level is less than the first, the device acts as an expander wherein the decrease in the internal energy of the compressible fluid can be transformed into power for utilization elsewhere.

Essentially the same apparatus 10 to be described hereinafter is useful either as a compressor or an an expander, with only minor modifications which will be apparent to those skilled in the art based on principals of the rotating fluid machinery art already known and those to be elucidated in the subsequent discussion. Also, the compressible fluid to be utilized in the present invention can be any of the more common materials such as air, steam, etc., or can be a complex mixture of gases such as would result if the apparatus 10 were used to expand the gases emanating from a combustion chamber.

In accordance with the invention, there is provided a pair of tangential rotors of circular cross section rotatable in a housing. As embodied in the apparatus shown in FIGS. 1 and 2A, apparatus 10 includes a housing 12 wherein there is situated a first rotor 14 and a second rotor 16 positioned on parallel axes 18 and 20, respectively, for rotation in housing 12 in a tangential relationship. Preferably, the rotors are mounted on respective shafts 22 and 24 which are journalled for rotation in bearing assemblies 26*a*, 26*b* and 28*a*, 28*b* which are mounted in housing 12. A lubrication system for the bearings can be provided to be driven by one of the shafts, such as shaft 22 in FIG. 1. The rotors 14 and 16 can be affixed to the respective rotating shafts 22 and 24 by any conventional means such as keys 30 and 32, respectively.

First rotor 14 and second rotor 16 have peripheral surfaces 34 and 36 which are closely adjacent at the line of tangency 38. For reasons that will become apparent in the succeeding discussion, the line of tangency 38 should be fluid-tight. This can be accomplished in any of a number of ways easily understood by one of ordinary skill in the art, including spacing axes 18 and 20 such that only a running clearance is established between peripheral surfaces 34 and 36 at the line of tangency 38, while providing substantially no leakage in the tangential direction past line 38.

In accordance with the invention, there is further provided a fluid-tight region formed in the housing adjoining the peripheral surface of one of the rotors, the region being in the shape of a segment of an annulus terminating at each end at the peripheral surface of the other rotor. As embodied herein, and as best seen in FIG. 2, a segmented annular region 40 is formed surrounding rotor 14. The boundaries of this region are designated in FIG. 2A by the letters WXYZ and include the peripheral surface 34 of rotor 14 as the inner annular boundary and the peripheral surface 36 of rotor 16 as the boundary for the segment ends of region 40 at W-X and Y-Z.

As can be best seen in FIG. 2A, rotors 14 and 16 have radii r and R, respectively, and are disposed in overlapping circular cavities 42 and 44 in housing 12. Axes 18 and 20 of rotors 14 and 16, respectively, coincide with the axes of the respective cavities and are spaced approximately r+R apart, that is, enough to maintain a running clearance between the peripheral surface 34 and 36. As embodied herein, the radius of cavity 44 in which rotor 16 is disposed is approximately R, again to allow a running clearance, but the radius of cavity 42 in which rotor 14 is disposed has a radius r' which is significantly greater than the radius r of rotor 14, as is shown in FIG. 2A. In the embodiment shown in FIGS. 1–7, cavity 42 also has a radius of about R. As can be best seen in FIG. 1, cavity 42 includes opposing end walls 46 and 48 and a peripheral wall 50 which, together with the peripheral surface 34 of rotor 14 and peripheral surface 36 of rotor 16 define segmented annular region 40.

As will be understood by one of ordinary skill in the art reading the subsequent discussion, the space between cavity end walls 46 and 48 and the adjacent axial faces of rotor 14, namely faces 52 and 54, must be of substantially fluid-tight in order to ensure the fluid tightness of region 40. Once again, this can be accomplished by spacing faces 52 and 54 from walls 46 and 48, respectively, a distance sufficient to provide a running clearance while providing a fluid seal. Or, sealing means (not shown) can be employed between the rotor faces and the adjacent end walls, as can be appreciated by one of ordinary skill in the art.

Further in accordance with the present invention, there is provided vane means on the peripheral surface of one of the rotors, the extremities of the vane means sealingly engaging the opposing surfaces of the housing that bound the annulus. As embodied in the apparatus shown in FIG. 2B, a single vane member 60 is fixed to rotor 14 at the peripheral surface 34. Vane member 60 has a radial extremity 62 which slidingly engages the peripheral surface 50 of housing 12 for providing a running seal. Axial extremities 64 and 66 of vane member 60 are similarly in sealing engagement with adjacent inner walls 46 and 48, respectively, for achieving sealing at the sides of vane member 60. As will be apparent to those of ordinary skill in the art, other means (not shown) can be used to effect the required running seals in place of the close fitting tolerances employed in the embodiment shown in FIGS. 1–7.

Further in accordance with the invention there is provided relief means in the peripheral surface of another of the rotors, which relief means is shaped for receiving the vane means during rotation of the rotors such as to allow the vane means to pass the point of tangency of the rotors. As embodied herein, and as best seen in FIG. 2A, notch 70 is provided in rotor 16, the notch having a maximum depth of at least r'−r to provide sufficient clearance for the passage of vane member 60. Notch 70 has opposing tangential sides 72 and 74 forming corresponding axially directed edges 76 and 78 at the intersection with the peripheral surface 36 of rotor 16.

As further embodied herein, and as best seen in FIG. 1, means are provided for coupling the tangential rotors for dependent rotation in opposite angular directions and for providing registration of the vane means and the vane relief means. In apparatus 10 shown in FIG. 1, gears 82 and 84 are fixed to shafts 22 and 24, respectively, and are in mating engagement at the line of tangency 86. Other means (not shown) for coupling rotors 14 and 16 are possible, but gears 82 and 84 are preferred because they provide a positive registration of vane member 60 with notch 70 such as is preferred to achieve the desired seal between the parts thereof, as will be explained henceforth.

Figure 3:
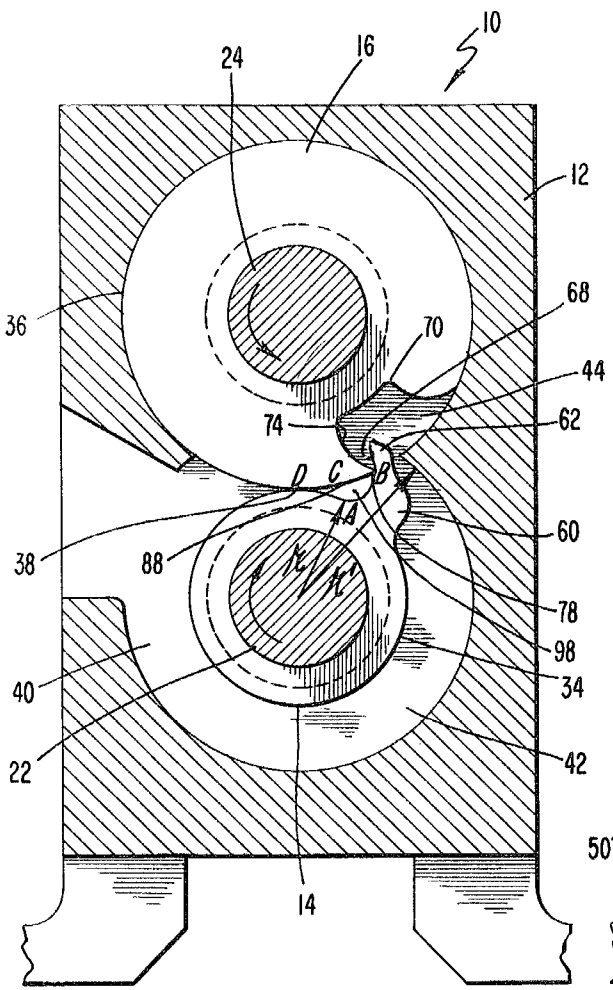

Also in accordance with the invention, the vane means and the vane relief means are in sealing relationship for part of the period when the vane means is received in the vane relief means during rotation of the vane means past the rotor with the vane relief means. As embodied herein, and as best seen in FIG. 3, vane member 60 has a tangentially directed vane face 68 which is generally concave inward in shape. The precise radial profile of vane face 68 corresponds to the path of edge 78 on the vane member 60 during concurrent rotation of rotors 14 and 16. Such a profile is easily understandable by one of ordinary skill in the art, and metal forming and cutting techniques and machinery are available to those skilled in the art for forming such a profile.

Figures 6, 7, 8:
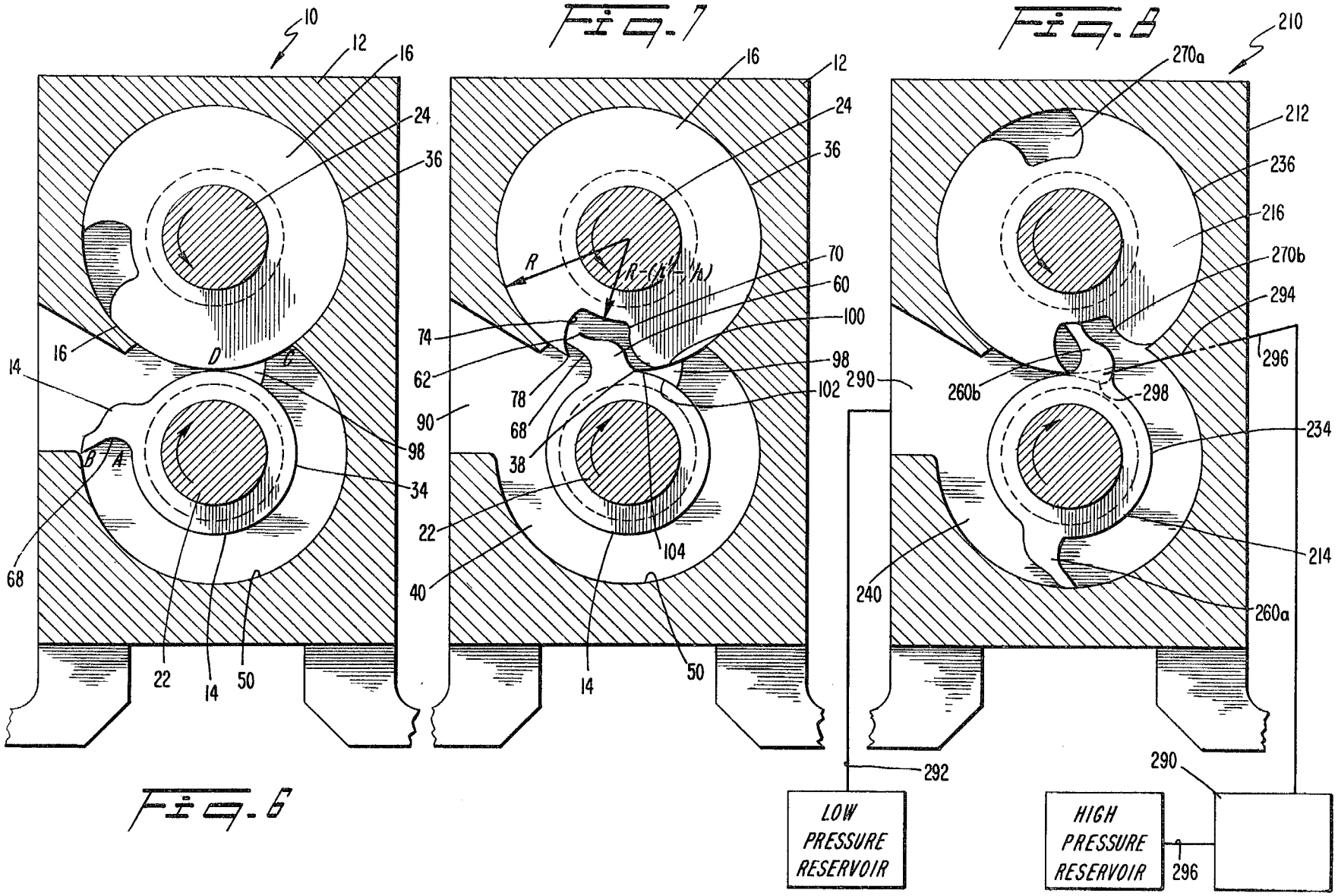
FIG. 8 is a cross-sectional view of another embodiment of the present invention.

Again, referring to FIG. 3, and with respect to the direction of rotation of rotors 14 and 16 as indicated by the arrows, registration between the vane member 60 and the notch 70 is established such that edge 78 of notch 70 contacts the innermost portion of face 68 when edge 78 passes the line of tangency 38 and subsequently rides along the face 68 until it passes and clears extremity 62 of vane member 60. During this period the engagement between edge 78 and face 68 is a fluid-sealing engagement. One of ordinary skill in the art would realize that sealing means (not shown) could be utilized to effect the required seal between edge 78 and vane face 68 in an alternate construction. During the other portion of the engagement of vane member 60 with notch 70, that is, from a position such as shown in FIG. 7 before edge 78 reaches the point of tangency, vane extremity 62 can slide along notch side 74. The tangential side 74 of notch 70 has essentially the same profile shape as vane face 68 to prevent interference with the vane extremity 62. The profile of notch side 74 thus corresponds to the path traced by vane extremity 62 from a radius R to a radius $R-(r'-r)$ in rotor 16. While the profile of notch side 74 is similar to the profile of vane face 68, a fluid sealing engagement is not required between notch side 74 and vane extremity 62, thereby permitting larger tolerances in the dimensions of notch side 74.

In accordance with the invention, at least two paths are provided in the housing for fluid flow into and out of the segmented annular region at different pressures. As embodied herein, and with respect to FIG. 2A, a low pressure port 90 is provided in the wall of housing 12 communicating directly with region 40. Port 90 and low pressure conduit 92 connect region 40 and a low pressure reservoir for the compressible fluid, which can be the atmosphere in cases wherein apparatus 10 is being used as a compressor for air or in the case where apparatus 10 is being used as an expander and the expanded fluid is simply discharged to the atmosphere. Port 90 is shown radially directed with respect to the axis of rotor 14, but it can also be formed to communicate with region 40 in the axial direction such as through one of the end walls of cavity 42. Also, the shape of port 90 can be determined as a matter of convenience and/or to increase the efficiency of the overall process as would be well known to those of ordinary skill in the art of fluid flow.

As embodied herein, and as can be seen in FIGS. 2A and 7, a flow path 94 is provided in housing 12 for flow of the fluid at high pressure. Flow path 94 is shown connected to conduit 96 communicating with a high pressure reservoir which can be of the atmosphere if the apparatus 10 is being operated as a sub-atmospheric compressor or expander. High pressure flow path 94 terminates at high pressure port 98 in end wall 48 of cavity 42 which forms one of the boundaries of region 40.

Preferably, and as best seen in FIG. 7, high pressure port 98 is positioned near the point of convergence of the projections on end wall 48 of the peripheral surfaces 34 and 36 of rotors 14 and 16, respectively, that is, the line of tangency 38. It is also preferred that the high pressure port 98 be generally in the shape of an elongated triangle with elongated sides 100 and 102 with an included vertex 104 oriented with the vertex directed toward the point of convergence. It is also preferred for reasons of decreased flow losses through high pressure port 98 that the sides 100 and 102 be concave inward with radii of curvature of about R and r, respectively.

In accordance with the invention, valve means are provided for intermittently interrupting the fluid in the path carrying the high pressure fluid. As embodied herein, and as shown in FIG. 2A, valve means 106 which can be of conventional design and operation can be positioned outside of housing 12 such as in conduit 96, or, preferably, can be positioned within the housing along flow path 94 proximate the high pressure port 98. As one of ordinary skill in the art would appreciate, valve means 106 can be synchronized with the rotation of rotors 14 and 16 to permit flow of a predetermined amount of fluid to or from the segmented annular region 40 through port 98 in conjunction with the angular position of the rotors. Conventional mechanical, hydraulic or pneumatic means can be used for synchronization and operation of the valve means.

It is still further preferred that where the group of tangential rotors mounted on parallel shafts can be designated a set of cooperating rotors, at least one additional set of cooperating rotors be mounted on the same shafts together with attendant additional vane means, vane relief means, segmented annular region, valve means, and flow paths into and out of the additional segmented annular region. As embodied herein, and with reference to FIG. 1, and outline of an additional set of rotors 130 is presented showing preferred orientations with respect to axes 18 and 20. This arrangement will be easily understood by one of ordinary skill in the art who would appreciate that additional rotor sets would add to the capacity of the machine, while at the same time benefiting from the dependent rotation and consequent positive registration of the additional vane means (not shown) and vane relief means (not shown) afforded by the coupling means connecting shaft 22 and 24, namely, gears 82 and 84. Also, the angular positions of the additional vane means and vane relief means can be staggered with respect to the positions of vane members 60 and notch 70 to achieve more balanced operations, much like the staggered piston arrangement in conventional reciprocating internal combustion engines.

Operation of the apparatus 10 made in accordance with the present invention will now be explained with reference to FIGS. 3–7 which show apparatus 10 being used as an expander, that is, to reduce the pressure of a mass of fluid. Turning first to FIG. 3, when the notch edge 78 has passed the line of tangency 38 and is in sliding engagement with vane face 68, a mass of high pressure expansible fluid is released through high pressure port 98 into the confined portion 88 of segmented annular region 40 designated ABCD, that is, the portion bounded by peripheral surface 36 of rotor 16, vane face 68, peripheral surface 34 of rotor 14, and the respective opposing end walls of cavity 42. In this position, the respective portions of peripheral surface 36, vane face 68, and peripheral surface 34 proximate the high pressure port 98 act to guide the mass of high pressure fluid into the region portion ABCD due to the similarity in shape with the triangular shaped outlet port 98.

Figure 5:
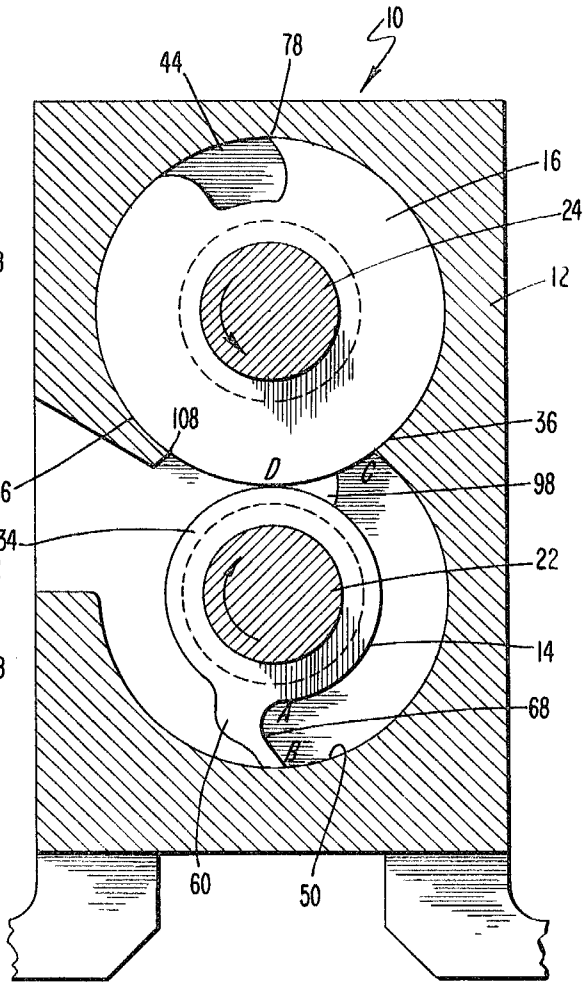
FIGS. 3–7 show the embodiment of FIG. 1 in various stages of the operation of the apparatus.
Figure 4:
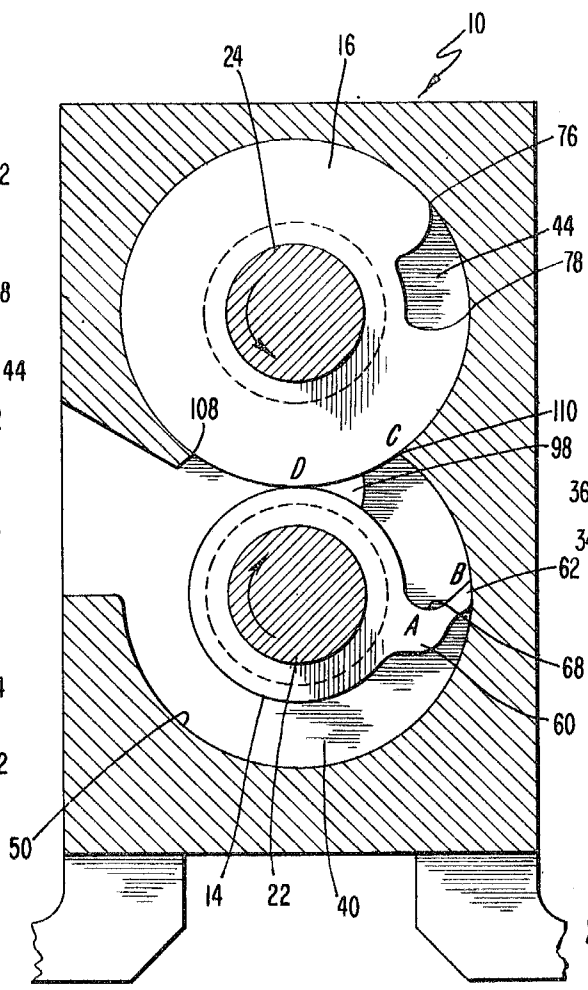

FIG. 4 shows rotors 14 and 16 at a subsequent angular position wherein the region portion ABCD has increased in volume due to the movement of vane member 60 with face 68 which trails in the tangential direction, thereby increasing the arcuate length of the volume 40 contained within the region portion ABCD. FIGS. 5 and 6 show successive stages in the expansion cycle wherein the region portion ABCD in which the mass of expansible fluid is trapped continues to grow in size due to the tangential movement of the vane member 60.

During the expansion cycle, the pressure of the expansible fluid trapped in the region portion ABCD is decreasing due to the increase in volume of ABCD. Also, as the trapped expansible fluid is continually acting against the vane face 68, it is possible to extract energy from the trapped fluid in the form of a torque on the rotor 14 which can be utilized elsewhere. In the compressor mode, energy would have to be added to apparatus 10 via rotor 14 to compress the confined fluid. FIG. 7 shows the rotors at the completion of the expansion cycle where the vane mamber 60 has been received within notch 70 after the expanded fluid has been released from the segmented annular region 40 through low pressure port 90.

It will be appreciated from a review of the operation of the apparatus 10 of the present invention that if the direction of rotation of the respective rotors 14 and 16 were reversed, the apparatus could be used as a compressor wherein the vane face 68 becomes the leading face of vane member 60 and entraps a mass of low pressure compressible fluid in the region portion ABCD approximately as is shown in FIG. 6. Subsequently, the cycle portion for the apparatus 10 being used as a compressor are as shown in FIG. 5, FIG. 4 and FIG. 3, successively, in that order. At the point shown in FIG. 3, the valve means 106 would allow flow of the compressed fluid in region ABCD to flow through port 98 and to the high pressure reservoir via path 94 and conduit 96 (see FIG. 2A).

It is also apparent from a review of the operation of the apparatus 10 shown in FIGS. 3–7 that there are two points of the cycle wherein the edge 78, vane extremity 62 and the peripheral surface 50 of cavity 42 are virtually coincident, namely at points 108 and 110 as depected in FIG. 4. Proper orientation and registration between edge 78 and extremity 62 at these points is provided by the dependent rotation and positive registration afforded by gears 82 and 84 shown in FIG. 1.

Figure 9:
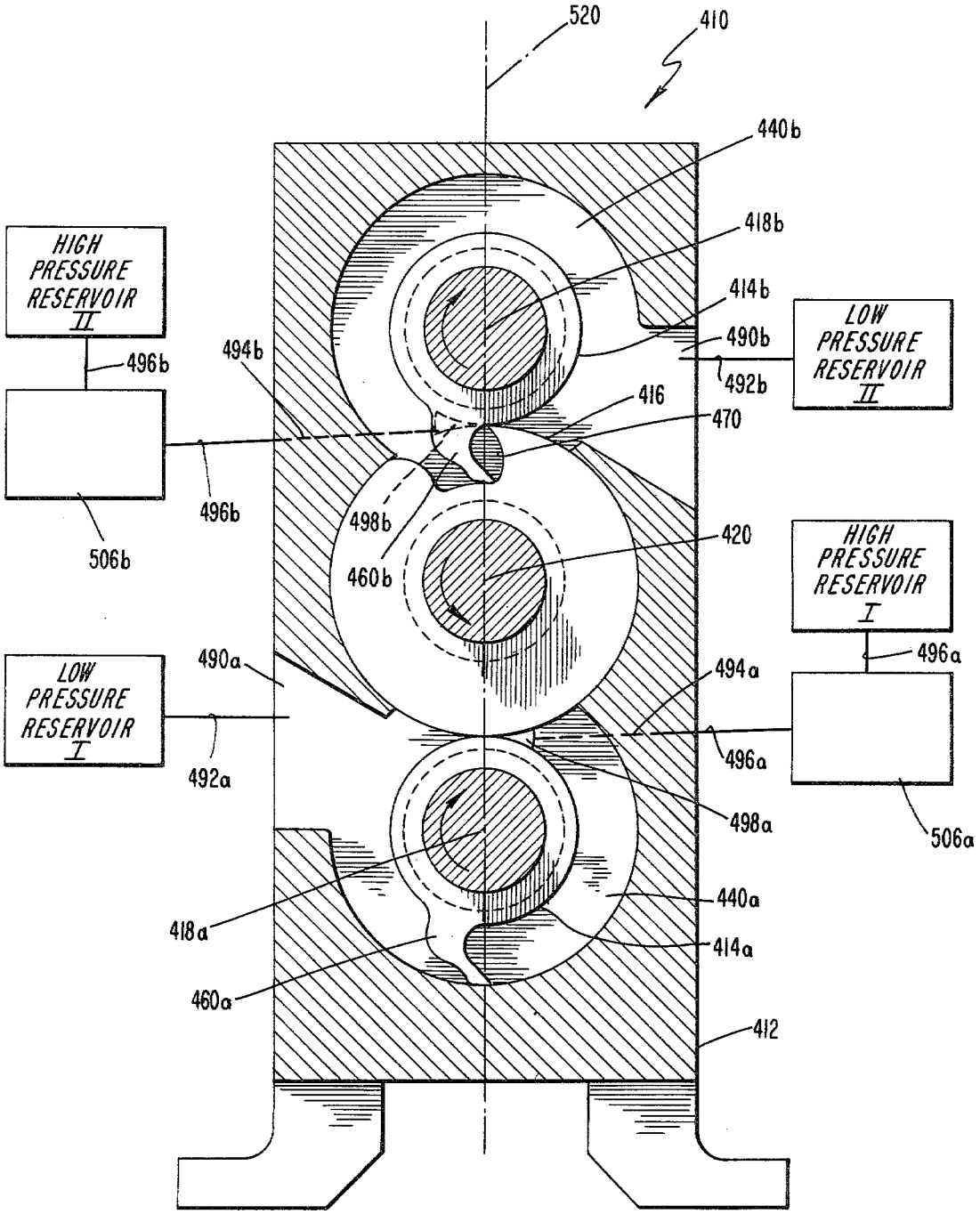
FIG. 9 is a cross-sectional view of another embodiment of the present invention.
Figure 10:
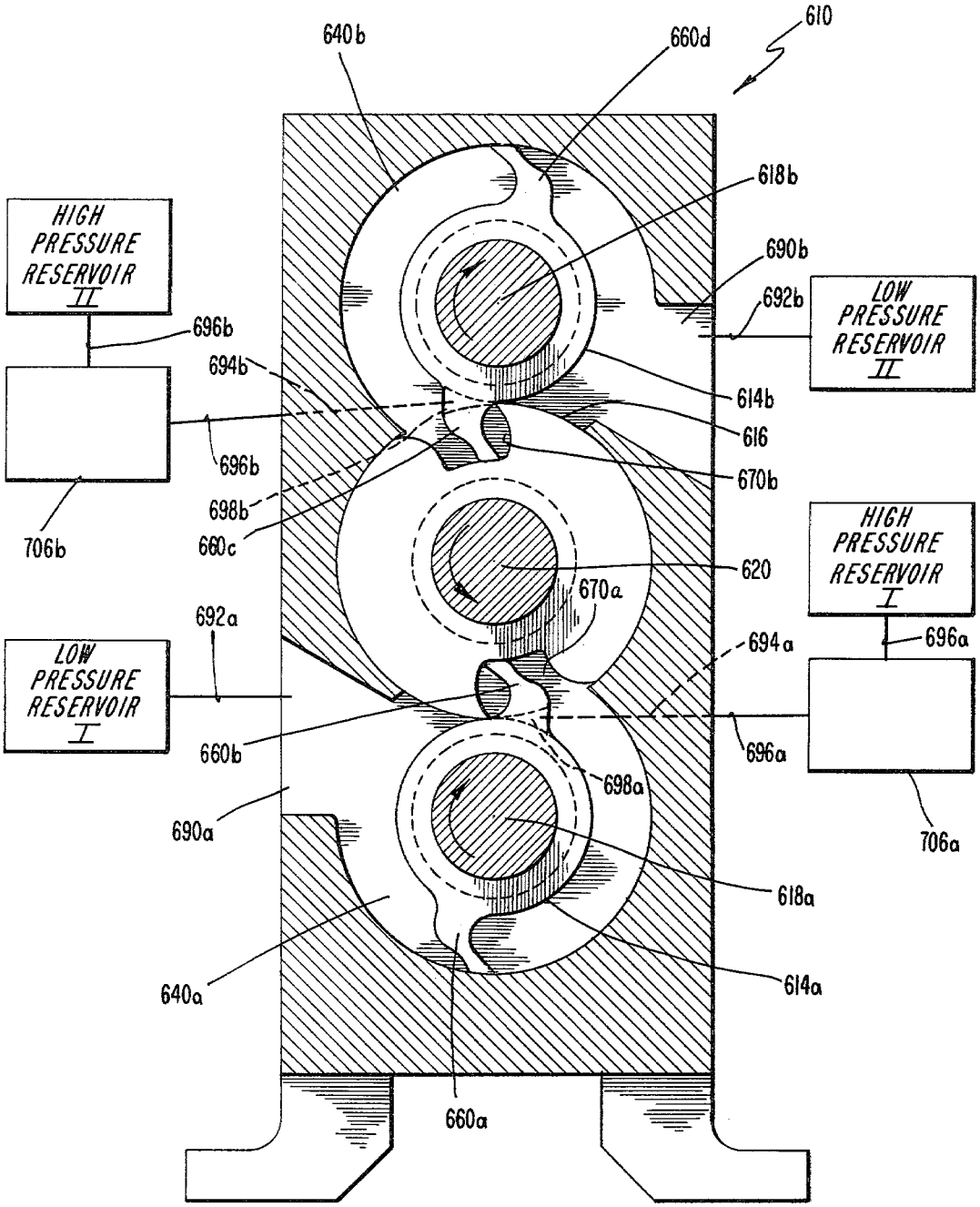
FIG. 10 is a cross-sectional view of a fourth embodiment of the present invention.

In the alternative embodiment of the present invention, as shown in FIGS. 8, 9 and 10, the same basic principles are employed as in the apparatus 10 previously described, but these alternative embodiments have the following significant features which differentiate over the apparatus 10.

In reference to FIG. 8, wherein components similar similar to the components of apparatus 10 shown in FIGS. 1–7 are designated by the same numerals, but with a 200 base added, there is shown a first rotor 214 and a second rotor 216 having peripheral surfaces 234 and 236, respectively. These rotors together with the end walls of cavity 242 formed in housing 212 form an annular region 240 which is fluid-tight. Two vane members 260*a* and 260*b* are provided for alternate registration with two notches 270*a* and 270*b* provided in rotor 216. Vane members 260*a* and 260*b* are positioned at diametrically opposite positions on rotor 214 and notches 270*a* and 270*b* are at diametrically opposite positions on rotor 216. Each individual vane member and its respective notch cooperate in essentially the manner discussed previously in relation to the embodiment shown in FIGS. 1–7. That is, for the case of apparatus 210 being used as an expander, valve means 306 operates allowing a mass of high pressure fluid to enter the portion of region 242 bounded by the trailing face of one of the vane members 260*a* or 260*b* and is subsequently expanded, and the expanded fluid released through low pressure port 290 to low pressure reservoir through low pressure conduit 292.

Because of the presence of two vane members 260*a* and 260*b*, the volume change in the defined portion of annular portion 242 is only approximately one-half the volume change in the apparatus shown in FIGS. 1–7 for the following reason. When the fluid being expanded becomes confined in a region between the trailing face of one vane member and the leading face of another vane mamber, no further expansion occurs because there is no change in arcuate length of the confined portion of region 242. This embodiment may be useful in certain applications because there occur two pressure "pulses" per rotation as compared to the single pressure pulse with the embodiment of FIGS. 1–7.

FIG. 9 shows another alternative embodiment of the apparatus made in accordance with the present invention. Apparatus 410 performs in essentially the same manner as the apparatus 10 discussed previously and shown in FIGS. 1–7, except as to be discussed henceforth. Again, components of apparatus 410 which are like the components of apparatus 10 shown in FIGS. 1–7 are given like number references but beginning from a base 400.

As embodied herein, and as shown in FIG. 9, apparatus 410 includes two first rotors 414*a* and 414*b* cooperating with a single second rotor 416. Rotor 414*a* rotates in housing 412 on axis 418*a* and rotor 414*b* rotates on an axis 418*b* which is parallel to axis 418*a*. Second rotor 416 rotates on axis 420 in housing 412, which axis is parallel to axes 418*a* and 418*b*. Preferably, the three axes 418*a*, 418*b* and 420 lie in the same plane 520.

In apparatus 410, a single vane member 460*a* is affixed to rotor 414*a* and a single vane member 460*b* is affixed to rotor 414*b*. Rotor 416 is provided with only a single notch 470 which alternately engages vane members 460*a* and 460*b*. Vane members 460*a* and 460*b* are positioned in identical angular positions on their respective rotors 414*a* and 414*b*.

During operation, which will be described in terms of the use of apparatus 410 as an expander, respective valve means 506*a* and 506*b* operate to permit masses of fluid to enter the respective portions of annular regions 440*a* and 440*b* through conduits 496*a* and 496*b*, and housing flow paths 494*a* and 494*b* and high pressure ports 498*a* and 498*b*, respectively. Following closing of the respective valve means 506*a* and 506*b*, the masses of fluid confined by the respective vane members 460*a* and 460*b* expand because of the changes in confined volumes caused by the subsequent rotation of these members towards respective outlet ports 490*a* and 490*b*. Upon reaching the respective outlet ports, the low pressure, expanded fluid flows through the ports to respective low pressure reservoirs through respective low pressure conduits 492*a* and 492*b*.

It will be appreciated that the respective high pressure reservoirs I and II shown in FIG. 9 can be the same reservoir or different reservoirs, and similarly, the low pressure reservoirs I and II can be the same or different. Advantages of the apparatus 410 used as an expander over that shown in FIGS. 1–7 include smoothing out of the torque incident on the output shaft (not shown) in much the same fashion as multiple, staggered cylinders provide in a reciprocating combustion engine. As in the two rotor apparatus shown in FIGS. 1–7 and in FIG. 8, the three rotors 414*a*, 414*b*, and 416 are coupled for dependent rotation, 414*a* and 414*b* rotating in like angular directions opposite to the angular direction of 416. Also, the coupling means (not shown) for the apparatus 410 will provide alternate registration between the vane members 460*a* and 460*b* in the notch 470.

A final embodiment of an apparatus made in accordance with the present invention is shown in FIG. 10. Again, components similar to the components discussed in relation to the embodiment shown in FIGS. 1–7 are given like numerical references but with a base of 600 added to the number reference used in FIGS. 1–7.

As embodied therein, apparatus 610 includes the two first rotors 614*a* and 614*b* and a single second rotor 616. As in the embodiment shown in FIG. 9, the three rotors rotate on parallel coplanar axes 618*a*, and 618*b* and 620. However, as distinguished from apparatus 410 shown in FIG. 9, apparatus 610 has two vane members positioned on each of the rotors 614*a* and 614*b*, namely vane members 660*a* and 660*b* on rotor 614*a* and vane members 660*c* and 660*d* on rotor 614*b*, the vane members on an individual first rotor being positioned on diametrically opposite sides of the respective rotor, and the angular positions of the vane members on rotor 614*a* being the same as the corresponding angular positions of the vane members on rotor 614*b*. Second rotor 162 has two notches 670*a* and 670*b* for alternating engagement with a specific vane member on each of rotors 614*a* and 614*b*.

In operation, being used as an expander, apparatus 610 simultaneously reduces the pressure of two separate masses of expansible fluid which can be received from separate high pressure reservoirs I and II through respective valve means 706*a* and 706*b*, conduits 696 and 696*b*, housing paths 694*a* and 694*b*, and finally entering the respective segmented annular regions 640*a* and 640*b*, through respective high pressure ports 698*a* and 698*b*. Again, the operation of the respective rotors for achieving the expansion of the separate masses of fluid admitted to the portions of the regions 640*a* and 640*b* confined by the respective vane members is substantially that as described in relation to the embodiment shown in FIG. 8, except that the total mass of expansible fluid treated by the apparatus 610 can be twice that of the apparatus shown in FIG. 8 for identical rotor and rotor cavity dimensions. Also, as was the case for the embodiment shown in FIG. 9, the respective high pressure reservoirs I and II can be the same reservoir as can the respective low pressure reservoirs I and II.

In the case where the high pressure reservoirs I and II are the same reservoir, the respective valve means 706*a* and 706*b* can be combined to a single valve means because the timing of each valve means in regard to the admission to the respective confined portion of the segmented annular regions 640*a* and 640*b* will be substantially the same. That is, for identical rotor and rotor cavity dimensions, the respective valve means 706*a* and 706*b* will open and shut at the same time to admit substantially the same amount of expansible fluid to the respective confined portions of the annular regions 640*a* and 640*b*. However, as it is preferred to place the respective valve means 706*a* and 706*b* as close to the respective high pressure ports 698*a* and 698*b* as possible, it may be desirable to retain two separate valve means as is shown in FIG. 10.

It will be apparent to those skilled in the art that various modifications and variations could be made in the apparatus of the present invention without departing from the scope or spirit of the invention.

What is claimed is:

1. Apparatus for changing the pressure of a mass of compressible fluid, the apparatus comprising:

a housing;

at least one first rotor of circular cross section of radius r mounted for rotation in said housing;

a second rotor of circular cross section of radius R mounted for rotation in said housing tangent to, and in fluid-tight relation with, said first rotor, wherein the angular direction of rotation of said second rotor is opposite that of said first rotor;

vane means fixed to the periphery of said first rotor for rotation therewith, said vane means including at least one vane member extending generally radially outward from the first rotor periphery, the thickness of said vane member measured in the tangential direction generally decreasing with increasing radial distance from the first rotor periphery;

vane relief means including at least one notch formed in the periphery of said second rotor cooperating with said vane means for providing rotation of said vane member past said second rotor, wherein inner surfaces of said housing form a segmented cylindrical annular region with the peripheral surface of said first rotor, said segmented annular region being bounded at the segment ends by the peripheral surface of said second rotor;

low pressure conduit means for communicating with said region at a first angular position with respect to the axis of said first rotor;

high pressure conduit means for communicating with said region at a second angular position, said second angular position being proximate one of the segment ends, valve means for intermittently interrupting communication with said region through said high pressure conduit after the passage of a predetermined mass of fluid, said vane member being in sealing engagement with said inner housing surfaces during rotation of said vane member between about said first and about said second angular positions and defining a fluid-tight variable volume portion of said region between said vane member and the peripheral surface of said second rotor proximate said second position, the mass of fluid being confineable within the variable volume portion of said region, the pressure of the confined fluid changing with the change in arcuate length and volume of said portion with the rotation of said vane member, the mass of fluid undergoing pressure change in said variable volume portion being sealed off from said vane relief notch by said vane member during pressure changing angular movement of said vane member past said second angular position, wherein said at least one vane member fixed to the peripheral surface of said first rotor has a tip extending a maximum radial distance of r′ from the axis of said first rotor, and wherein said at least one notch formed in the peripheral surface of said second rotor is configured for registration with said vane member, said notch having a maximum depth of at least 4′−r measured radially from the peripheral surface of said second rotor, and wherein said vane member has a face directed toward the confined fluid mass and said notch forms an axially directed edge with the peripheral surface of said second rotor, said vane member tip, said notch edge, and the inner peripheral wall of said housing all being in coincidence at one point during rotation of said vane member past said second angular position and wherein the profile of said vane face corresponds to the path traced on a hypothetical disc of radius r′ affixed to and rotating coaxially with said first rotor, from a radius r to a radius r′, by a point on said notch edge during the concurrent rotation of said first and second rotors, said notch edge slidingly engaging said vane face during rotation of said vane member between the point of tangency of said first and said second rotors and the point of coincidence for providing a fluid-tight seal between said face and said edge during rotation of said vane face between said respective points, said second angular position lying between said respective points.

2. The apparatus as in claim 1 wherein said first and said second rotors are fixedly attached to respective separate shafts mounted for rotation in said housing, the apparatus further including means for coupling said respective shafts for providing rotation of said first and said second rotors in opposite angular directions, said coupling means also providing registration between said vane means and said vane relief means during rotation of said first and said second rotors.

3. The apparatus as in claim 1 wherein said first rotor and said second rotor together with the associated vane means and vane relief means constitute a rotor set, the apparatus further comprising at least one additional set of rotors with additional vane means and additional vane relief means affixed to the same respective shafts and cooperating with said housing for forming at least one additional segmented annular region for changing the pressure of another mass of fluid.

4. The apparatus as in claim 1 wherein two vane members are provided at diametrically opposite angular positions on said first rotor, and wherein two notches are provided on said second rotor at diametrically opposite angular positions, each of said two vane members being in registration with a different one of said two notches.

5. The apparatus as in claim 1 wherein the portion of said segmented region confining the fluid mass increases in arcuate length and volume with the rotation of said vane member, the confined fluid mass expanding and decreasing in pressure, wherein said face trails said vane member and said edge trails said notch relative to the direction of rotation of the respective rotors.

6. The apparatus as in claim 1 wherein the portion of said segmented region confining the fluid mass decreases in arcuate length and volume with the rotation of said vane member, the confined fluid mass contracting and increasing in pressure, wherein said face leads said vane member and said edge leads said notch relative to the direction of rotation of the respective rotors.

7. The apparatus as in claim 1 wherein said first and second rotors are disposed in said housing in respective tangentially overlapping cavities of a circular cross section, said cavities positioned on parallel cavity axes spaced about r+R apart, the radius of the cavity in which said second rotor is disposed being about R and the radius of the cavity in which said first rotor is disposed being greater than r, the peripheral inner surface of the cavity in which said first rotor is disposed forming part of the boundary of said segmented annular region.

8. The apparatus as in claim 7 wherein both of said cavities have a radius of about R.

9. The apparatus as in claim 1 wherein said low pressure conduit means includes a low pressure port in the wall of the housing cavity in which said first rotor is disposed.

10. The apparatus as in claim 1 wherein two first rotors are provided for cooperation with said second rotor, said two first rotors and said second rotor being mounted in said housing for rotation on separate parallel axes.

11. The apparatus as in claim 10 wherein said parallel axes lie in the same plane and said vane means includes at least one vane member mounted on each of said two first rotors, said two first rotors and said second rotor all being coupled for dependent rotation by coupling means providing rotation of said two first rotors in the same angular direction and opposite from the angular direction of said second rotor, said vane members being positioned on said respective first rotors in the same angular position relative to the direction of rotation for providing alternating engagement with said notch, said coupling means also providing positive registration of said vane members with said notch during rotation of said two first rotors and said second rotor.

12. The apparatus as in claim 1 wherein said low pressure conduit means includes a low pressure port positioned in the peripheral wall of the housing cavity in which said first rotor is disposed, communication between the mass of fluid in said annular region and said low pressure conduit means being established upon said vane means passing said low pressure port.

13. The apparatus as in claim 1 wherein said valve means is positioned proximate said segmented annular region.

14. The apparatus as in claim 1 wherein said high pressure conduit means includes a high pressure port in flow communication with said segmented annular region at said second angular position, and wherein said vane face, the portion of the peripheral surface of said first rotor proximate said vane face, and the portion of the peripheral surface of said second rotor proximate said axial edge cooperate to channel fluid flowing through said high pressure port.

15. The apparatus as in claim 1 wherein said mass of fluid flows between said high pressure conduit and said variable volume portion when the non-axial boundaries of said variable volume portion consist essentially of said vane face and the peripheral surfaces of said first and second rotors.

16. Apparatus for changing the pressure of a mass of compressible fluid, the apparatus comprising:

a housing;

at least one first rotor of circular cross section of radius r mounted for rotation in said housing;

a second rotor of circular cross section of radius R mounted for rotation in said housing tangent to, and in fluidtight relation with, said first rotor, wherein the angular direction of rotation of said second rotor is opposite that of said first rotor;

vane means fixed to the periphery of said first rotor for rotation therewith, said vane means including at least one vane member extending generally radially outward from the first rotor periphery, the thickness of said vane member measured in the tangential direction generally decreasing with increasing radial distance from the first rotor periphery;

vane relief means including at least one notch formed in the periphery of said second rotor cooperating with said vane means for providing rotation of said vane member past said second rotor, wherein inner surfaces of said housing form a segmented cylindrical annular region with the peripheral surface of said first rotor, said segmented annular region being bounded at the segment ends by the peripheral surface of said second rotor;

low pressure conduit means for communicating with said region at a first angular position with respect to the axis of said first rotor;

high pressure conduit means for communicating with said region at a second angular position, said second angular position being proximate one of the segment ends, valve means for intermittently interrupting communication with said region through said high pressure conduit after the passage of a predetermined mass of fluid, said vane member being in sealing engagement with said inner housing surfaces during rotation of said vane member between about said first and about said second angular positions and defining a fluid-tight variable volume portion of said region between said vane member and the peripheral surface of said second rotor proximate said second position, the mass of fluid being confineable within the variable volume portion of said region, the pressure of the confined fluid changing with the change in arcuate length and volume of said portion with the rotation of said vane member, the mass of fluid undergoing pressure change in said variable volume portion being sealed off from said vane relief notch by said vane member during pressure changing angular movement of said vane member past said second angular position, wherein said at least one vane member fixed to the peripheral surface of said first rotor has a tip extending a maximum radial distance of r′ from the axis of said first rotor, and wherein said at least one notch formed in the peripheral surface of said second rotor is configured for registration with said vane member, said notch having a maximum depth of at least r′−r measured radially from the peripheral surface of said second rotor, and wherein said vane member has a face directed toward the confined fluid mass and said notch forms an axially directed edge with the peripheral surface of said second rotor, said vane member tip, said notch edge, and the inner peripheral wall of said housing all being in coincidence at one point during rotation of said vane member past said second angular position and wherein the profile of said vane face corresponds to the path traced on a hypothetical disc of radius r′ affixed to and rotating coaxially with said first rotor, from a radius r to a radius r′, by a point on said notch edge during the concurrent rotation of said first and second rotors, said notch edge slidingly engaging said vane face during rotation of said vane member between the point of tangency of said first and said second rotors and the point of coincidence for providing a fluid-tight seal between said face and said edge during rotation of said vane face between said respective points, said second angular position lying between said respective points, and wherein said housing includes a pair of opposing end walls facing the respective axial faces of said first rotor and forming part of the boundary of said segmented annular region, said high pressure conduit means including a high pressure port located in one of said pair of end walls immediately adjacent the projection of the convergence of the peripheral surfaces of said first and second rotors on said one end wall, said high pressure port having a generally triangular shape with a vertex pointing toward the convergence of the peripheral surfaces of said first and second rotors.

17. The apparatus as in claim 16 wherein the two sides of the triangular port forming said vertex are each concave inward with respective radii of curvature of r and R, respectively, and the third side is convex outward.

18. The apparatus as in claim 16 wherein said vane member, the portion of the peripheral surface of said first rotor proximate said vane member, and the portion of the peripheral surface of said second rotor proximate said notch cooperate to channel fluid flowing through said high pressure port.

* * * * *

UNITED STATES PATENT AND TRADEMARK OFFICE

CERTIFICATE OF CORRECTION

PATENT NO. : 4,312,629

DATED : January 26, 1982

INVENTOR(S) : Emmanouil A. Pelekis

It is certified that error appears in the above—identified patent and that said Letters Patent is hereby corrected as shown below:

Claim 1, column 10, line 39, change "4' - r" to read --r' - r--.

Signed and Sealed this

*Twelfth* Day of *October 1982*

[SEAL]

*Attest:*

GERALD J. MOSSINGHOFF

*Attesting Officer*

*Commissioner of Patents and Trademarks*